United States Patent [19]

Martens

[11] Patent Number: 4,989,276

[45] Date of Patent: Feb. 5, 1991

[54] VENTILATED TOILET

[76] Inventor: Henry H. Martens, #209-33095 Old Yale Rd., Abbotsford, B.C., Canada, V2S 6C7

[21] Appl. No.: 313,284

[22] Filed: Feb. 17, 1989

Related U.S. Application Data

[63] Continuation of Ser. No. 155,820, Feb. 16, 1988, abandoned.

[51] Int. Cl.[5] ..... E03D 9/05

[52] U.S. Cl. ..... 4/349; 4/216

[58] Field of Search ..... 4/213–219, 4/348–352

[56] References Cited

U.S. PATENT DOCUMENTS

| | | | |
|---|---|---|---|
| 1,501,291 | 7/1924 | Raper et al. | 4/349 |
| 2,351,560 | 6/1944 | Thompson et al. | 4/213 |
| 2,406,507 | 8/1946 | Owens | 4/215 |
| 2,777,137 | 1/1957 | McFadden | 4/213 |
| 2,778,033 | 1/1957 | Majauskas | 4/213 |
| 2,851,696 | 9/1958 | Schotthoefer | 4/216 |
| 3,069,696 | 12/1962 | Howell | 4/213 |
| 3,230,552 | 1/1966 | Schulz | 4/218 |
| 3,495,282 | 2/1970 | Taggert | 4/213 |
| 3,605,126 | 9/1971 | Henry | 4/215 X |
| 3,913,150 | 10/1975 | Poister et al. | 4/217 X |
| 4,133,060 | 1/1979 | Webb | 4/351 X |
| 4,165,544 | 8/1979 | Barry | 4/216 X |
| 4,494,255 | 1/1985 | Drummond | 4/213 |

FOREIGN PATENT DOCUMENTS

| | | | |
|---|---|---|---|
| 2114778 | 8/1979 | Fed. Rep. of Germany | 4/213 |
| 1054919 | 1/1967 | United Kingdom | 4/213 |

*Primary Examiner*—Charles E. Phillips

*Attorney, Agent, or Firm*—Jackson & Richardson

[57] ABSTRACT

This invention relates to a ventilated toilet system for removing obnoxious odors from the toilet bowl and includes integral vent channels formed along the base and the back inside of the water tank, and a vent adapter mounted inside the passage that directs the flow of ventilating air along the vent channels to an exhaust pipe and discharges it by a remote in-line exhaust fan to the outside atmosphere. The adapter is attached to the base of the overflow flush valve pipe or, conversely, designed to be an integral part of the overflow flush value pipe, itself, and is positioned to connect the base vent channel of the water tank to the toilet water inlet chamber of the bowl for passage of ventilating air, and to connect the overflow flush valve pipe to the water inlet chamber for passage of flush water.

6 Claims, 3 Drawing Sheets

FIG. 4
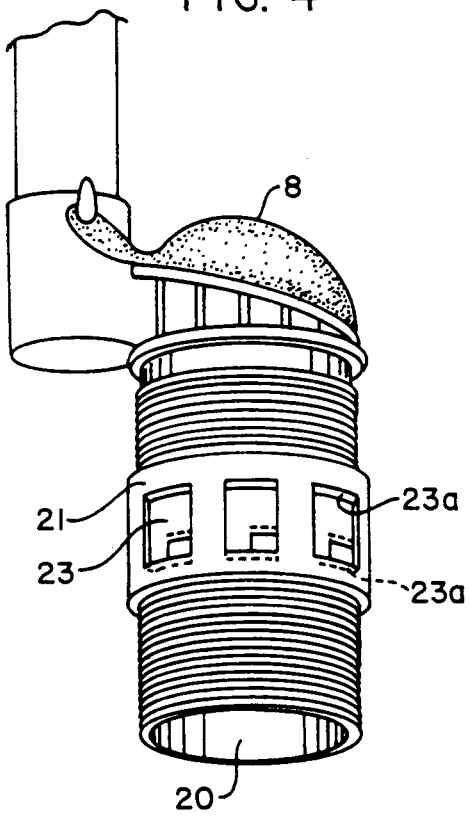
FIG. 5
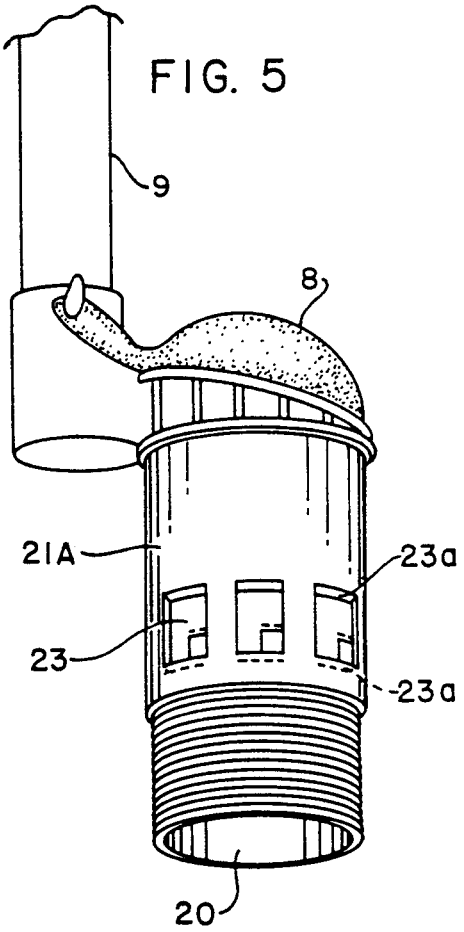
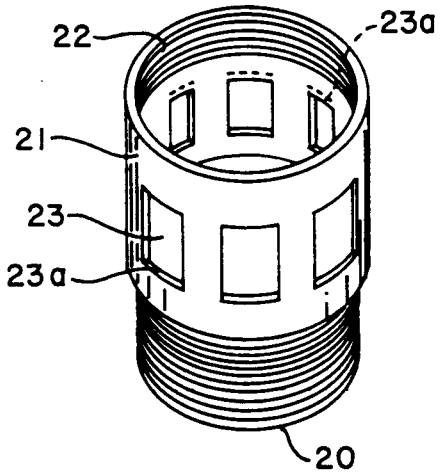
FIG. 3
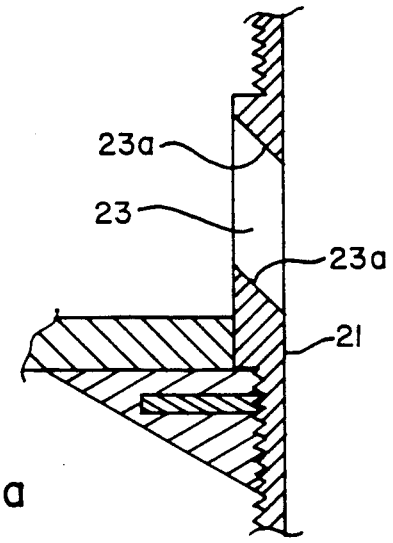
FIG. 6a

VENTILATED TOILET

This application is a continuation application based on prior copending application Ser. No. 07/155,820, filed Feb. 16, 1988, for VENTILATED TOILET now abandoned.

BACKGROUND OF THE INVENTION

The invention described below relates to a toilet system for the purpose of removing obnoxious odors promptly from the basin before they enter the room during toilet usage.

The tendency in recent years towards closed rooms with air conditioning has brought about a change in the location of bathrooms, particularly in apartments, town houses, motels and hotels. In former years the bathroom was placed on an outside wall for ventilation to be obtained by means of a window, while the tendency today is to place bathrooms in an inside room and thus make the more desirable outside rooms available for living rooms. There is consequently a greater need for improved ventilation of the modern bathroom over the inefficient conventional method of ceiling vents.

Various types of devices for ventilating toilet bowls have been proposed and can be categorized into several groups according to their construction and mode of operation.

A number of devices exist where the ventilation system is attached to the seat, is a part of the seat, or is built into the seat itself. Typical of these are: U.S. Pat. No. 4,620,329, which discloses a toilet having an internal channel in the seat for the conveyance of air through hollow hinge mechanisms; and U.S. Pat. No. 4,094,023, which discloses a toilet seat having a perforated suction tube attached on the underside and an exhaust tube running down that extends into the bowl. These ventilation systems can cause a sanitary problem due to the presence of baffles, channels and openings along the underside of the seat and/or tubing located in the bowl which present a breeding ground for bacteria.

Other devices exist in which the ventilation system is formed in the toilet bowl independent of the water closet, and these require reconstruction of the bowl itself as in U.S. Pat. Nos. 3,938,201 and 4,222,129. Once again unsanitary conditions are present.

Still other systems exist which are attached to the toilet bowl or hung on the side thereof such as in U.S. Pat. No. 4,317,242. These designs result in either an inconvenient or hazardous condition.

There are ventilating devices where the ventilation is achieved through the overflow pipe, such as is exhibited in U.S. Pat. Nos. 4,232,406, 4,165,544 and 3,495,282. These inventions all suffer from insufficient airflow volume to adequately ventilate the toilet.

Ventilating devices also exist that are positioned between the seat and the toilet bowl as exhibited in U.S. Pat. Nos. 3,069,696 and 4,402,091. These devices suffer from safety and sanitation problems due to the additional tubing and vents.

A few designs provide a ventilating system by adding a vent adapter between the toilet bowl and the water tank, all in communication with one another, as exhibited in U.S. Pat. Nos. 2,777,137, 3,230,552 and U.S. Pat. No. 4,494,255. Because the vent adapter is not an integral part of either the toilet bowl or the water closet, the device itself, as well as the crevices formed by the planes of connection, once again pose sanitation hazards and/or air flow constraints. Also, this exposed vent adapter is unsightly.

U.S. Pat. No. 2,351,560 uses a vent adapter positioned in the water inlet connecting the closet to the bowl, but requires a major structural change in the configuration of the water closet to house a suction fan and motor assembly, and the motor wiring creates an electrical hazard.

In general, the above ventilation systems have one or more of the following problems: inadequate sanitation, unsightly appearance, physical obstruction, electrical shock hazard, lack of plumbing code compliance and/or expense.

It is an object and purpose of this invention to create a toilet ventilating system that is attractive, simple, and efficient by using a remotely located air exhaust blower fan that causes the unpleasant odors to be drawn off through the existing flush water apertures of the toilet bowl rim and through the associated vent pipes without requiring major structural reconfiguration of the water closet and associated plumbing.

A further objective of this invention is to provide a practical, durable, simple, inexpensive, and sanitary system of eliminating unwanted odors from the bathroom in an energy efficient manner. Energy loss is minimized by providing a relatively short interval of exhaust fan operation as compared to the prolonged usage of a less efficient bathroom fan.

SUMMARY OF THE INVENTION

I have devised a ventilation system for removing odors from the toilet in which the flush water apertures spaced around the inner periphery of the toilet bowl rim of a conventional stool type toilet draw off odors in the opposite direction of water flow. These odors then pass through the air space in the water channel of the toilet stool, through the stool's water inlet chamber, then through a vent adapter connecting the toilet bowl water inlet chamber to a base vent channel provided in the base of the water tank, and then through the water tank base vent channel itself. The vent adapter is fastened onto the base of the overflow flush valve pipe to act as a dual purpose channel through which flush water passes from the water tank to the toilet bowl's water inlet chamber, as well as serving as a part of the channel for the passage of ventilating air flow. Once the odors pass through the vent channel in the base of the water tank, the air flow proceeds up a vent channel provided along the back of the water tank and out through an opening port in the back of the tank that in turn communicates with a vent pipe having an in-stream exhaust fan mounted at a remote location.

BRIEF DESCRIPTION OF THE DRAWINGS

In the drawings:

FIG. 3 is a perspective view of the vent adapter that screws onto the base of the overflow flush valve pipe.

FIG. 4 is a perspective view of the vent adapter joined with the overflow flush valve pipe, converting it into one unit.

FIG. 5 is a perspective view of an alternate embodiment of the overflow flush valve pipe manufactured as an integral unit with an extended base containing the vent holes.

FIG. 6*a* is a cross sectional view of the adapter taken at line 6*a*—6*a* of FIG. 6 at the location of the venting apertures.

The foregoing as well as other objects and advantages of the present invention may be more clearly understood by reference to the following detailed description which illustrates the preferred embodiment and various alternative features of the present invention.

The novel features believed to be characteristic of this invention are set forth in the appended claims. The invention itself, however, may be best understood and its various objects and advantages best appreciated by reference to the detailed description below in connection with accompanying drawings.

DETAILED DESCRIPTION

Figure 1:
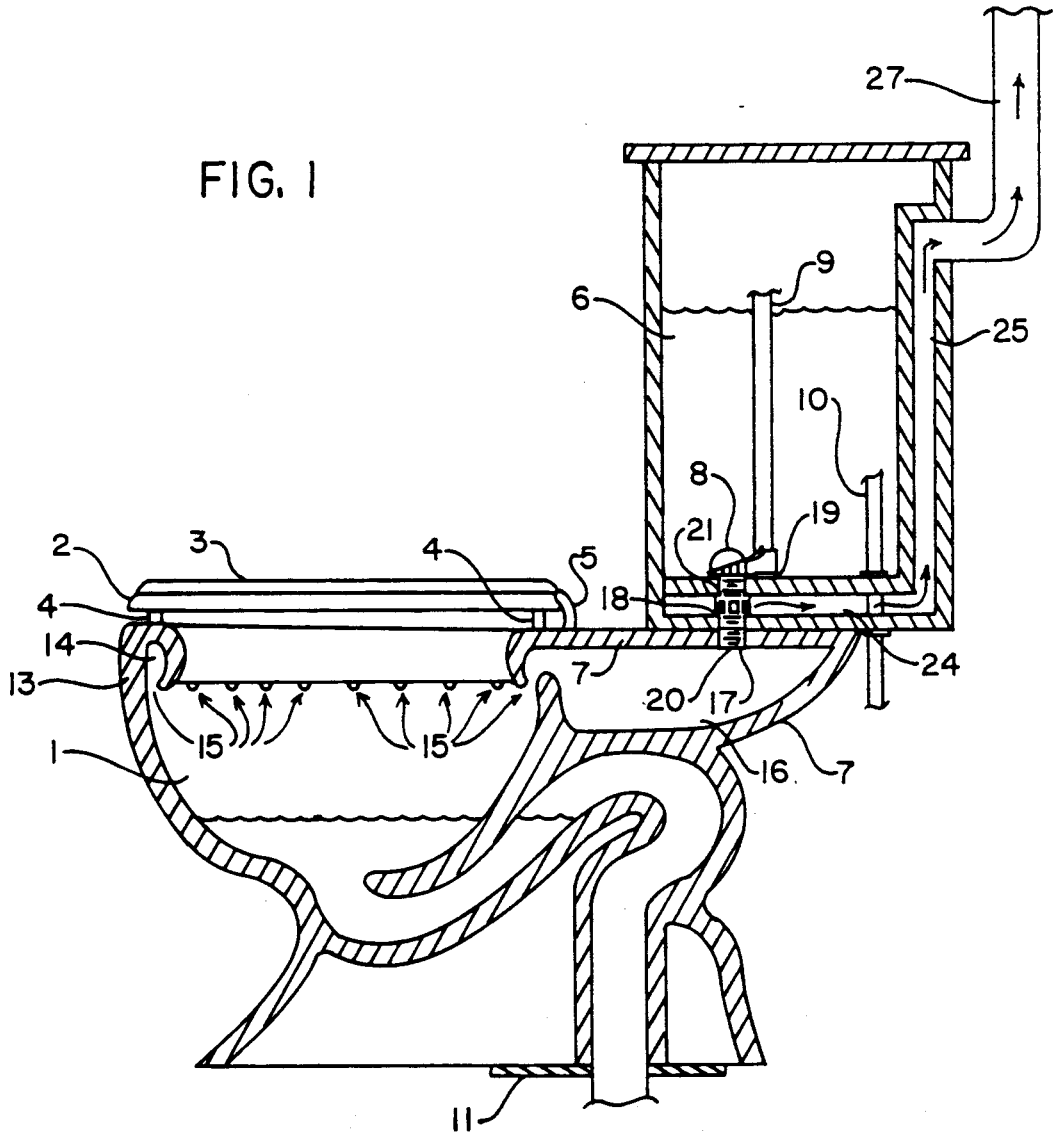
FIG. 1 is a vertical cross section view of the bowl type toilet and water closet with vent adapter of this invention.

In FIG. 1 the conventional toilet bowl 1 is provided with the usual hinged seat 2 and cover lid 3 having the usual bumper buttons 4, by which the seat is spaced a short distance above the toilet bowl 1 when it is in the lowered position. The seat 2 is attached to the bowl by hinges 5. A water tank 6 is mounted on top of the usual bracket extension 7 of the toilet bowl 1. Inside of the water tank 6 is the usual water intake pipe 10 and the flush valve 8 attached to the overflow pipe 9. The stool type bowl 1 itself is attached by a base flange 11 by which it is secured to the floor.

Figure 2:
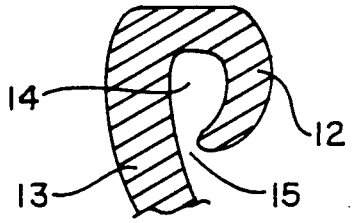
FIG. 2 is a fragmentary enlarged view showing a cross section of the upper toilet bowl rim.

This toilet bowl 1 possesses the usual water traps and flushing chambers. Inside of the top circumferential rim 12, which is part of the bowl wall 13, as illustrated in detail in FIG. 2, there is the usual circumferential channel 14 that possesses the usual water apertures 15 spaced around the inner periphery of rim 12. The passing of water through the water apertures 15 causes flushing of the water in the bowl 1. These apertures 15 also act as vent holes through which air is drawn in the opposite direction of the flow of water.

Figure 6:
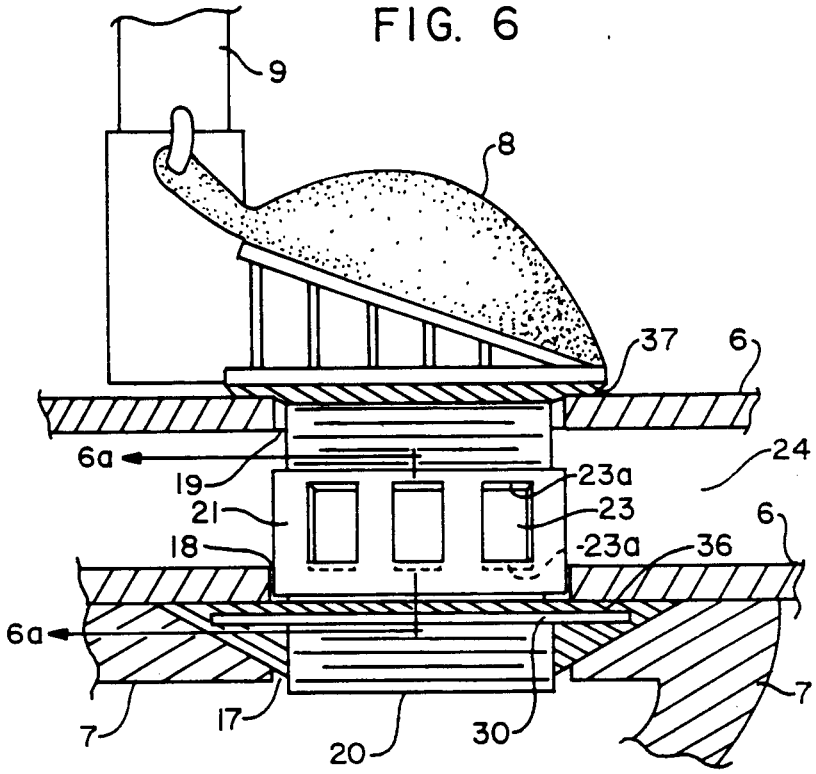
FIG. 6 is a fragmentary enlarged vertical, cross sectional view of the overflow flush valve pipe together with the vent adapter and a portion of the water tank base vent channel.

Referring to FIG. 1 and FIG. 6, both before and after flushing, the odor and air is drawn off through the apertures 15 into the water channel 14 of the toilet bowl 1, into the water inlet chamber 16, which is within the bracket extension 7 of the toilet bowl 1, and into the orifice of lower neck 20 of vent adapter 21. Vent adapter 21 connects open port 17 of bracket extension 7, lower water discharge opening 18 of the water tank 6, and the upper water discharge opening 19 of the water tank 6 as illustrated in FIG. 6.

Figure 7:
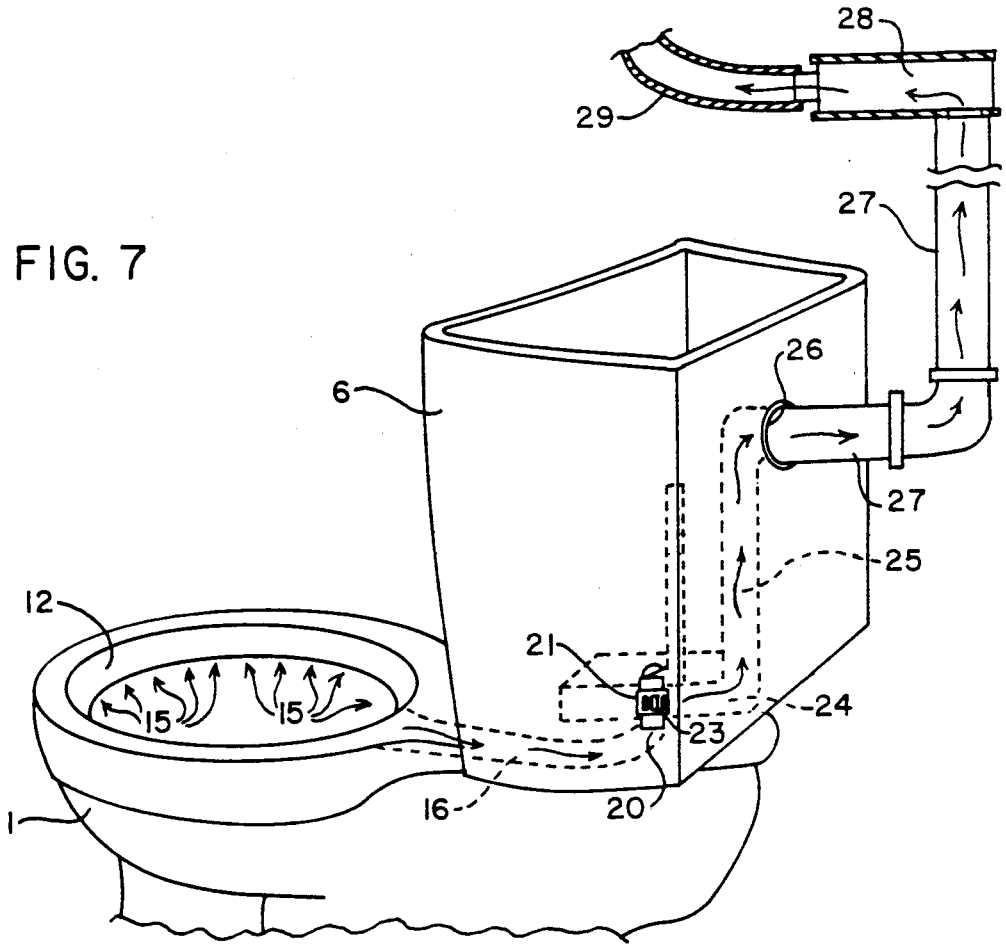
FIG. 7 is a view in perspective of the bowl type toilet showing by direction arrows the flow of ventilating air through the toilet rim, the vent adapter, and the vent channels in the water tank and out through the vent pipes, by means of a blower type fan.

After the odors enter the orifice within the lower neck 20 of vent adapter 21, they pass through the rectangular adapter apertures 23 positioned at and around the adapter's circumferential perimeter, and then pass into the base vent channel 24 in the bottom of the water tank 6, as shown in FIGS. 6 and 7. From the base vent channel 24 the odors are drawn into the connecting back vent channel 25 located in the back of the water tank 6 as viewed in FIG. 1 and FIG. 7. The odors then pass through the exhaust port 26 near the top backside of the water closet 6, into which is fitted a ventilating pipe 27 connected to a blower type fan 28 mounted in the ceiling or wall. After passing through the fan compartment 28, the odor and air is forced on through the flexible conduit hose 29 and expelled into the outside atmosphere. The base vent channel 24 and the back vent channel 25 have sufficient cross sectional flow areas to maintain a high volume, low pressure airflow within the system.

The vent adapter 21, as shown in FIG. 3, is of a hollow tubular construction and attaches to the bottom of the overflow flush valve 9, as illustrated in FIG. 4, by means of an inside screw-on thread 22. Vent adapter 21, besides allowing odor to discharge, is also the passageway for discharge of flushing water from the water tank 6 to the water inlet chamber 16 by means of the open port 17 of the bracket extension 7, as viewed in FIG. 6. FIG. 6 also shows that the vent adapter 21 is held in position by means of a screw-on flange nut 30 that attaches to the threaded lower neck 20 of the vent adapter 21, and by rubber washers 36 and 37.

As shown in FIG. 6*a*, top and bottom edges 23*a* of the rectangular adapter apertures 23 of adapter 21 are beveled at upward angles, sloping upwardly from the inner wall to the outer wall of said vent adapter, to prevent flush water from flowing out of the rectangular adapter apertures 23 as the water travels down vent attachment 21 when the toilet is flushed.

The base vent channel 24 and the back vent channel 25 are permanent structural modifications to the interior of water tank 6 that are of such an interior area to allow a large volume of air flow with low pressure.

An alternate embodiment of vent adapter 21 is shown in FIG. 5 as vent adapter 21A. This alternate embodiment is identical in every aspect to vent adapter 21 except that vent adapter 21A is an integral unit with flush valve 8, not requiring threaded-attachment to flush valve 8 as does vent adapter 21.

While particular embodiments of the present invention have been described in some detail herein above, changes and modifications may be made in the illustrated embodiments without departing from the spirit of the invention.

I claim:

1. A ventilating system for eliminating odiferous air from a commode of the type including a toilet bowl connected to a water tank via a bracket extension having an open port where the open port of the bracket extension communicates with the water discharge opening of the tank, and where the water tank includes a base portion, rear portion and an overflow flush valve, the ventilating system comprising:

a base vent channel integrally formed along the interior of the base portion of the water tank, said base vent channel forming an air and water tight enclosure between the water tank discharge opening and the remainder of the water tank, said base vent channel having an upper water discharge opening on its top surface;

an exhaust port aperture formed through the rear portion of the water tank;

a rear vent channel integrally formed along the interior of the rear portion of the water tank and communicating with said base vent channel to form a continuous air and water tight passageway for ventilating flow, said rear vent channel separating said exhaust port aperture located in the rear portion of the water tank from the remainder of the water tank;

a vent adapter comprising an elongated tubular body inserted perpendicularly through said base vent channel and extending upwardly through said upper water discharge opening to connect to the overflow flush valve pipe of the water tank in an air and water tight manner, and extending downwardly through the water tank discharge opening and the open port of the bracket extension to connect to the bracket extension in an air and water tight manner, and further comprising vent apertures located radially upon the portion of said tubular body of said vent adapter that resides within said base vent channel said vent apertures having beveled upper and lower edges along the longitudinal axis of said vent adapter, said upper and lower edges beveled upward and radially outward so as to channel downward flow of flushwater thereby minimizing diversion of flushwater through said apertures; and a ventilating pipe connected in an air and water tight manner to said exhaust port and adapted to be connected to a remote exhaust fan means.

2. The ventilation system of claim 1 wherein said base vent channel and said rear vent channel have sufficient cross sectional flow areas to maintain a high volume, low pressure airflow within said system.

3. The ventilation systems of claim 1 wherein said tubular body of said vent adapter is connected to said overflow flush valve pipe by gasket means and by fastener means.

4. The ventilation system of claim 1, wherein said tubular body of said vent adapter and the overflow flush valve pipe are formed from a singular, discrete piece of material.

5. In a ventilated toilet having a combined overflow and flush valve assembly including a standard threaded flush valve and cooperating nut, a toilet bowl connected to a water tank via a bracket extension having an open port communicating with a lower water discharge opening of the water tank, a base vent channel along with interior of the base portion of the water tank, such base vent channel having an upper water discharge opening in vertical alignment with the lower water discharge opening of the water tank, a rear vent channel along with interior of a rear portion of the water tank and communicating with the base vent channel and having an exhaust port adapted to connect to a ventilating duct, a vent adapter for such ventilated toilet comprising:

an elongated tubular body threaded at both ends and disposed in vertical axial alignment with the upper and lower water discharge openings so as to pass through the base vent channel and project upwardly into registration with the upper water discharge opening of the base vent channel for threaded connection to the flush valve of the combined overflow and flush valve assembly, and so as to extend downwardly through the lower water discharge opening of the water tank and project into the bracket extension for threadedly receiving the nut, said vent adapter thereby forming with the flush valve and nut an air and water tight seal at the upper and lower water discharge openings, respectively, and said vent adapter having vent apertures located circumferentially on and extending radially through a midlength portion of said tubular body which passes through the base vent channel wherein said tubular body of said adapter is configured at said vent apertures so that upper and lower edges of said apertures are beveled upward and radially outward so as to channel downward flow of flushwater thereby minimizing diversion of flushwater through said vent apertures, whereby odiferous air from the toilet bowl passes through the open port of the bracket extension and up through the lower discharge opening of the water tank, into the portion of said tubular body which passes through said base vent channel, radially outward through said vent apertures, along the base vent channel and the rear vent channel, to the exhaust port.

6. In a toilet having a toilet bowl, a water tank having a water discharge opening, and a bracket extension having an open port, a ventilation system comprising:

a base vent channel integrally formed along the interior base of said water tank, forming an air and water tight enclosure between the water discharge opening of said tank and the remainder of said water tank, and possessing, along the upper surface of said base vent channel, an aperture forming an upper water discharge opening;

a back vent channel integrally formed along the inside back of said water tank and communicating with said base vent to form a continuous air and water tight passageway for ventilating flow, said back vent channel separating the exhaust port aperture located in the back of said water tank from the remainder of said water tank;

a vent adapter comprising an elongated tubular body inserted perpendicularly through said base vent channel and extending upwardly through said upper water discharge opening to connect to the overflow flush valve pipe of said water tank in an air and water tight manner, and extending downwardly through said water discharge opening and the open port of the bracket extension of said toilet bowl to connect to said bracket extension in an air and water tight manner, and further comprising vent apertures located radially upon the portion of said tubular body of said vent adapter that resides within said base vent channel said vent apertures of said vent adapter having beveled upper and lower edges, along the longitudinal axis of said vent adapter, said upper and lower edges beveled upward and radially outward so as to channel downward flow of flushwater thereby minimizing diversion of flush water through said vent apertures; and a ventilating pipe connected in an air and water tight manner to said exhaust port located in the back of said water tank and adapted to be connected to a remote exhaust fan means.

* * * * *